US007112302B2

(12) United States Patent
Yoshimi et al.

(10) Patent No.: US 7,112,302 B2
(45) Date of Patent: Sep. 26, 2006

(54) METHODS FOR MAKING SHAPE MEMORY ALLOY PRODUCTS

(75) Inventors: Yoshiharu Yoshimi, Obu (JP); Yasushi Okumura, Nagoya (JP); Masataka Tokuda, Tsu (JP)

(73) Assignees: Yoshimi Inc., Obu (JP); MIE TLO Co., Ltd., Tsu (JP)

( * ) Notice: Subject to any disclaimer, the term of this patent is extended or adjusted under 35 U.S.C. 154(b) by 0 days.

(21) Appl. No.: 10/849,010

(22) Filed: May 20, 2004

(65) Prior Publication Data

US 2004/0231760 A1 Nov. 25, 2004

(30) Foreign Application Priority Data

May 23, 2003 (JP) ..... 2003-145971

(51) Int. Cl.

| | |
|---|---|
| ***B22F 3/23*** | (2006.01) |
| ***C22F 1/10*** | (2006.01) |
| ***C22F 1/18*** | (2006.01) |
| *C22C 14/00* | (2006.01) |
| *C22C 19/03* | (2006.01) |

(52) U.S. Cl. ..... 419/45; 419/46; 148/555; 148/563

(58) Field of Classification Search ..... 419/46, 419/45; 148/402, 563, 555

See application file for complete search history.

(56) References Cited

U.S. PATENT DOCUMENTS 4,732,556 A * 3/1988 Chiang et al. ..... 425/405.2
5,299,619 A * 4/1994 Chandley et al. ..... 164/53
2004/0057861 A1* 3/2004 Zhu et al. ..... 419/47

FOREIGN PATENT DOCUMENTS

| | | |
|---|---|---|
| JP | A 63-214342 | 9/1988 |
| JP | A 5-230561 | 9/1993 |
| JP | A 10-280061 | 10/1998 |
| JP | A 11-106880 | 4/1999 |
| JP | A 11-241128 | 9/1999 |
| JP | A 2000-54023 | 2/2000 |

OTHER PUBLICATIONS

Kasai et al., "Superelastic Ti-Ni Alloy Wire Intramedullary Nails for Metastatic Femoral Pathologic Fracture: A Case Report," Journal of Surgical Oncology, vol. 83, Issue 2, pp. 123-127, Jun. 2003.

Kaieda et al., "Combustion and Plasma Synthesis of High-Temperature Materials," Combustion Synthesis of Intermetallic Compounds, edited by Z.A. Munir et al., pp. 106-113, 1990.

(Continued)

*Primary Examiner*—Ngoclan T. Mai
(74) *Attorney, Agent, or Firm*—Oliff & Berridge, PLC

(57) ABSTRACT

The manufacturing methods according to the present teachings provide shape memory alloy products having both a uniform composition and a precise shape memory recovery temperature. In this manufacturing method, raw material powders (e.g., Ti and Ni powders) may be precisely mixed. Next, a compound may be synthesized from the raw material powder mixture using a combustion synthesis method. The combustion synthesized compound may be melted and cast into a desired shape (e.g., a shape of the final product or a shape close to that of the final product).

5 Claims, 5 Drawing Sheets

Diagram of The Self-Propagating High-Temperature Synthesis.(SHS)

OTHER PUBLICATIONS

Kaieda et al., "Self-Propagating High-Temperature Synthesis of Ni Ti Alloy: A New Production Process of Shape Memory Alloy from Elemental Powder," MRS International Meeting on Adv. Mats., vol. 9, Materials Research Society, pp. 623-628, 1989.

Kaieda, "Properties of TiNi Intermetallic Compound Industrially Produced by Combustion Synthesis," Advanced Synthesis and Processing of Composites and Advanced Ceramics, vol. 56, pp. 27-38, 1995.

* cited by examiner

Diagram of The Self-Propagating
High-Temperature Synthesis.(SHS)

METHODS FOR MAKING SHAPE MEMORY ALLOY PRODUCTS

CROSS REFERENCE

This application claims priority to Japanese patent application number 2003-145971, filed May 23, 2003, the contents of which are hereby incorporated by reference as if fully set forth herein.

BACKGROUND OF THE INVENTION

1. Field of the Invention

The present invention relates to methods for making shape memory alloy products (e.g., clasp, biological implant, sensor, socket, clip, switch, eyeglass frame, etc.).

2. Description of the Related Art

FIG. 5 shows a conventional method of manufacturing TiNi shape memory alloy product. As shown in FIG. 5, TiNi shape memory alloy is manufactured by the ordinary metallurgical processes of melting, hot forging, and rolling. Raw materials (e.g., sponge Ti and Ni pellets) are melted at 1,350 to 1,500° C. by a melting furnace (e.g., high-frequency vacuum induction melting furnace, arc melting furnace, or plasma-melting furnace). After the raw materials are melted, they undergo forging and rolling, and then is formed into a primary product (e.g., sheet or wire) through cold working. The primary product is machined and formed into the shape of the final product. Then, in order to get a shape memory effect or super-elasticity, a shape memory heat treatment is applied to the product that is formed into the shape of the final product. In the shape memory heat treatment, for example, the product is heated and held at a temperature of between 300 and 600° C. for several minutes to an hour, and is then cooled.

Further, Japanese Laid-open Patent Publication No. 11-106880 describes a method for manufacturing a shape memory alloy product. In this known manufacturing method, raw materials (e.g., sponge Ti and Ni pellets) for a shape memory alloy are melted and formed into an ingot. This ingot is then melted and cast using a casting mold. After the casting is finished, the cast alloy together with the casting mold is heated in a heating furnace (i.e., undergoes shape memory heat treatment). When the heat treatment is finished, the casting mold is removed. With this method, in order to get a super-elastic effect, the shape memory heat treatment must be applied while the cast alloy is constrained inside the casting mold.

SUMMARY OF THE INVENTION

However, in the known methods, gravity segregation occurs in the melting and/or casting process because of the big difference in the specific gravity between Ti and Ni. Consequently, it is difficult to control the phase transformation temperature (e.g., shape memory recovery temperature) accurately. Further, in the former method shown in FIG. 5, the primary product (e.g., sheet or wire) made of a shape memory alloy, which is a hard-to-process material, must be further machined in order to obtain the desired shape, thereby increasing manufacturing cost. On the other hand, in the latter method, because this method applies the heat treatment to the cast alloy constrained by the casting mold, a special casting mold that can be used in the heat treatment is required.

Accordingly, it is one object of the present teachings to provide improved manufacturing method capable of controlling the phase transformation temperature accurately and reducing manufacturing cost.

In one aspect of the present teachings, raw material powders (e.g., Ti and Ni powders) for shape memory alloy may be mixed and synthesized with the combustion synthesis. The combustion synthesized alloy (e.g., TiNi-based alloy) may be melted and then cast into a desired shape (e.g., a shape of the final product or a shape close to that of the final product). In the case where the combustion synthesized alloy is cast into the desired shape, gravity segregation is less likely to occur than in the case where a shape memory alloy manufactured by a conventional melting method is cast into the desired shape. Consequently, the final products, which is formed by casting the combustion synthesized alloy, has a precise phase transformation temperature (e.g., shape memory recovery temperature). Further, because a shape close to that of the final product can be obtained by casting method, manufacturing costs can be reduced.

Preferably, the mixed powder may include Ti and Ni powders as its main components. Further, the mixed powder may include additional elements (e.g., Cr, Fe, Co, V, Mn, Mo, B, Cu, Nb, etc.).

These features may be utilized singularly or, in combination, in order to make improved shape memory alloy products. In addition, other objects, features and advantages of the present teachings will be readily understood after reading the following detailed description together with the accompanying drawings and claims. Of course, the additional features and aspects disclosed herein also may be utilized singularly or, in combination with the above-described features.

DETAILED DESCRIPTION OF THE INVENTION

A method of manufacturing TiNi shape memory alloy product according to a representative embodiment of the present teachings will be explained below. The manufacturing method in this representative embodiment may comprise a combustion synthesis step, a casting step, and a shape memory heat treatment step.

[Combustion Synthesis Step]

Figure 1:
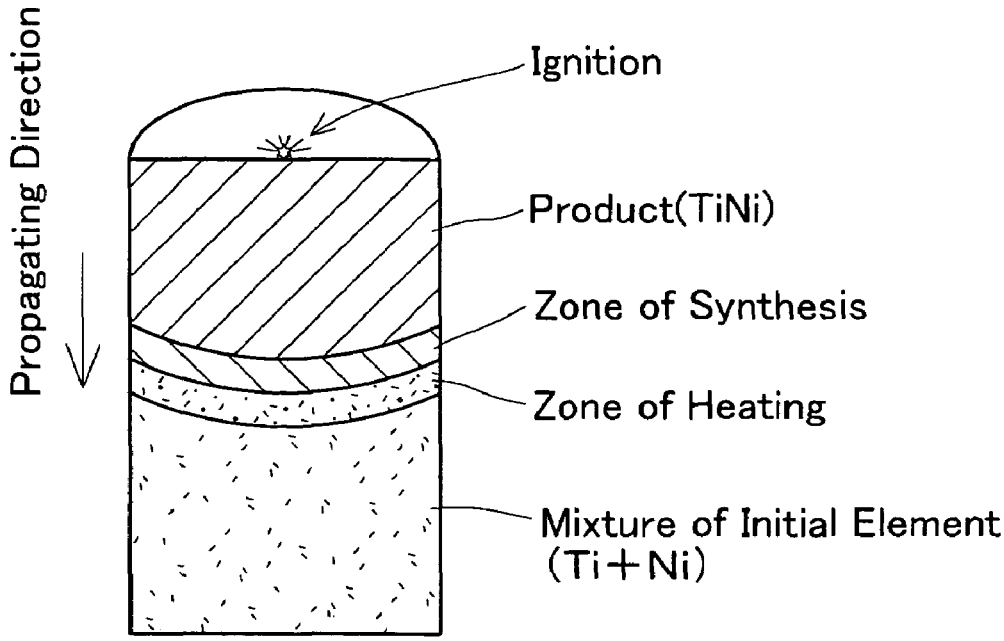
FIG. 1 shows a schematic diagram of the combustion synthesis process.

FIG. 1 shows a schematic illustration of the combustion synthesis process. First, raw material powders for shape memory alloy may be precisely mixed to produce the desired composition ratio. For example, a mixing ratio of Ti at 48–52% with Ni constituting the remainder can be used to set the desired phase transformation temperature. Next, a compound is synthesized from the raw material powder mixture using a combustion synthesis method. In combustion synthesis process, for example, the mixture of the raw material powder may be filled with a container (e.g., graphite crucible). The container may be placed in a combustion synthesis reactor. Then, the top of the raw material powder may be ignited by the electrical spark or the heat of electrical resistance of a heating wire (e.g., tungsten heating wire). Then, the exothermic chemical reaction occurs at the ignited portion and the heat of formation is released. This heat ( about 2200 to 2300° C.) is transmitted to the neighboring part of the mixture and ignites them. Again the exothermic chemical reaction occurs and the heat of formation is released. This chemical chain reaction is propagated to the end of the mixture and the whole mixture is transformed to the compound. During this combustion synthesis process, the raw materials do not melt macroscopically and are finished with an intermetallic compound with an extremely small number of impurities sintered on them. Detailed procedure of combustion synthesis is known (e.g., Japanese Patent publication No. 1816876) and thus, a detailed explanation will be omitted.

[Casting Step]

For the casting step, generally known methods, such as sand mold casting, lost wax, shell mold, and centrifugal casting, may be used. The desired method can be selected from these methods according to the shape and dimensions of the product and its mass-productivity. The combustion synthesized alloy is melted at about 1300° C. and cast. After the alloy has been cooled and solidified, it is released and removed from the casting mold. During this casting process, no special heat treatment is required.

[Shape Memory Heat Treatment Step]

The shape memory heat treatment may be applied to the product removed from the casting mold, within a temperature range of 300 to 600° C. for several minutes to several hours, resulting in super-elasticity or shape memory effect in the product. In this shape memory heat treatment, no restraining mold is required, and the shape memory heat treatment can be applied to the product in a free state. If it is necessary to alter or modify the shape of the product removed from the casting mold and to further apply a shape memory heat treatment, a heat treatment may be applied using a restraining mold.

The above illustrated representative manufacturing method can be applied to products in fields that have been known to use shape memory alloys. For example, the method can be applied to the clasps used for securing false teeth in dentistry. Other application examples include biological implants used for treating bone fractures and bonding staples used in surgeries. The manufacturing method according to the present teachings, which uses casting, is extremely effective in applications in which the product shape is complicated or machining is required in the middle of the manufacturing process. Applying the manufacturing method according to the present teachings to these products can reduce their manufacturing costs. Furthermore, the manufacturing method according to the present teachings can also be applied to the manufacture of various types of industrial components, such as sensors, sockets, and eyeglass frames.

EXAMPLES

Next, examples of the present teachings will be explained below. First, the composition ratio between the Ni and Ti powders was adjusted (to Ni at 50.1% and Ti at 49.9%) so that a shape memory effect could be obtained, and NiTi alloy was synthesized using the combustion synthesis method. This combustion synthesized NiTi alloy was then melted and formed into multiple pieces of straight material (with a diameter of ϕ1.9 mm and a length of 40 mm) using a precision casting method. One such piece is hereafter referred to as "Test Piece 1".

Additionally, the composition ratio between Ni and Ti powders was adjusted (to Ni at 50.7% and Ti at 49.3%) so that super-elasticity could be obtained, and NiTi alloy was synthesized using the combustion synthesis method. This combustion synthesized NiTi alloy was then melted and formed into multiple pieces of straight material (with a diameter of ϕ1.9 mm and a length of 40 mm) using a precision casting method. One such piece is hereafter referred to as "Test Piece 2".

Both Test Pieces 1 and 2 were straight when removed from the casting mold. Furthermore, Test Piece 1 exhibited a shape memory effect in the state in which it was removed from the casting mold (i.e., without application of any shape memory heat treatment).

Next, in order to provide the Test Pieces 1 and 2 with the required transformation points and bending strength, a shape memory heat treatment was applied. The specific heat treatment condition was as follows: After the Test Pieces was held at 460° C. for 60 minutes, they were water-cooled. The shape memory heat treatment was applied to both Test Pieces 1 and 2 in a free state (i.e., without any restraint). After the shape memory heat treatment, both Test Pieces 1 and 2 remained straight without any deformation.

After the shape memory heat treatment, both Test Pieces 1 and 2 were subjected to a metal material-bending test (JIS Z 2248) using the pressing bend method in an environment in which the room temperature was 20° C. Specifically a test piece was placed on two supports having a diameter of 10 mm (with a space of 26 mm between the two supports), a pressing bar having a radius of 10 mm was pressed against the center of the test piece, and a load was applied until the bending angle reached 90 degrees.

Test Piece 1 remained bent after the load from the pressing bar was removed. When this bent Test Piece 1 was heated, it returned to almost its original straight shape. This test confirmed that Test Piece 1 had been provided with a shape memory effect. On the other hand, Test Piece 2 returned to the straight shape after the load from the pressing bar was removed. This test confirmed that Test Piece 2 had been provided with a super-elastic effect. The above illustrated bending test was repeated 10 times on each test pieces respectively, and the above mentioned results were obtained in every case.

The shape memory effect was verified in each of the Test Pieces 1, and the super-elastic effect was verified in each of the Test Pieces 2. Therefore, it was verified that the manufacturing method according to the present teachings can stably provide a shape memory effect and a super-elastic effect.

Figure 2:
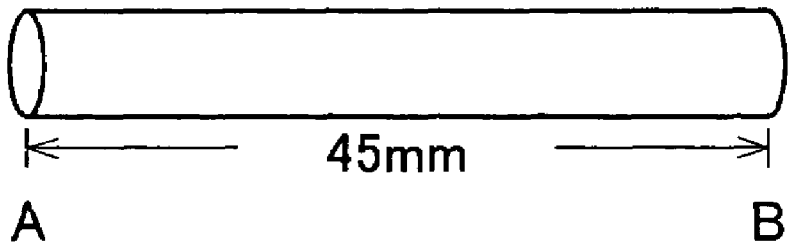
FIG. 2 is a perspective view showing an example of test pieces.

Further, combustion synthesized NiTi alloy was formed into "Test piece 3" (straight material with a diameter of ϕ2.0 mm and a length of 45 mm as shown in FIG. 2) using a precision casting method. Additionally, NiTi alloy, which had been manufactured by the conventional method, was formed into "Test piece 4" (straight material with a diameter of 42.0 mm and a length of 45 mm) using a precision casting method. A shape memory heat treatment was applied to both Test Pieces 3 and 4. Specifically, the Test Pieces 3 and 4 were held at 460° C. for 60 minutes, and then they were water-cooled.

Figure 3:
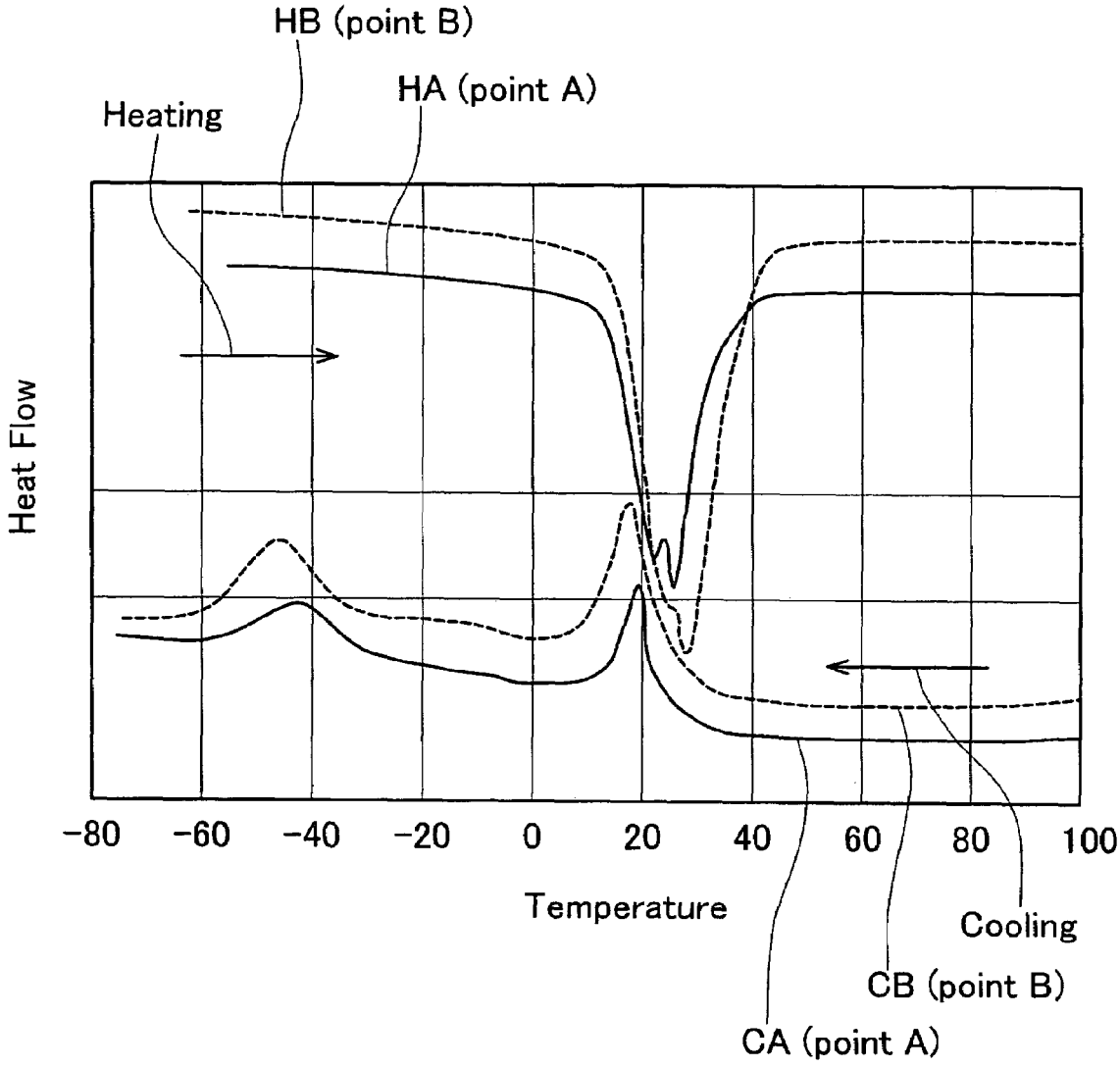
FIG. 3 shows an example of the DSC chart and the transformation temperatures of the test piece manufactured by the representative method of the present teachings.
Figure 4:
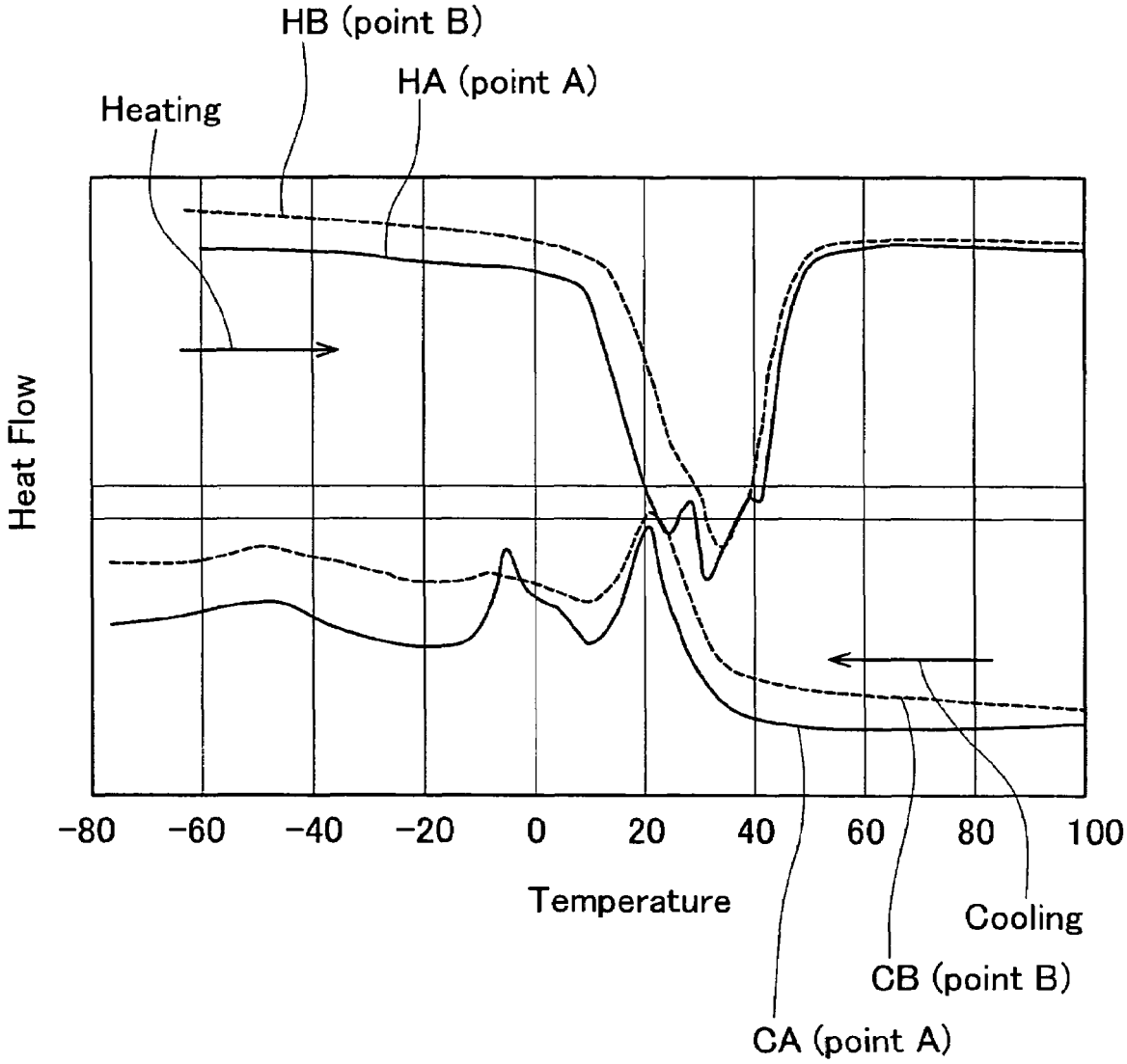
FIG. 4 shows an example of the DSC chart and the transformation temperatures of the test piece manufactured by the conventional method.
Figure 5:
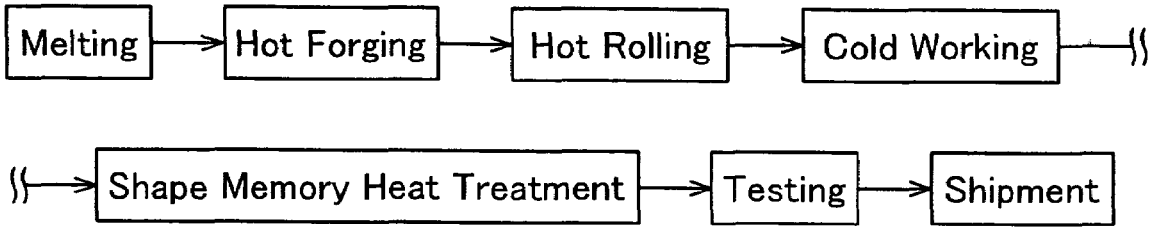
FIG. 5 PRIOR ART
FIG. 5 is a block diagram showing a conventional manufacturing process of TiNi shape memory alloy.

Then, the transformation temperature at each point A (i.e., one end of Test piece as shown in FIG. 2) and B (i.e., another end of Test piece as shown in FIG. 2) of Test pieces 3 and 4 were measured by the differential scanning calorimetry (DSC) method, respectively. FIGS. 3 and 4 show the DSC chart of each Test piece in which the peak of the transformation temperature of the Test piece 3 is clearly identified than that of the Test piece 4. This gives the proof that combustion synthesized NiTi alloy is homogeneous in chemical composition and the structure than the NiTi alloy manufactured by the conventional method.

Finally, although the preferred representative embodiment has been described in detail, the present embodiment is for illustrative purpose only and not restrictive. It is to be understood that various changes and modifications may be made without departing from the spirit or scope of the appended claims. In addition, the additional features and aspects disclosed herein also may be utilized singularly or in combination with the above aspects and features.

The invention claimed is:

1. A method of making a shape memory alloy product, comprising:

mixing raw material powders at a predetermined ratio, the raw material powders comprising Ni and Ti powders, synthesizing a compound from the raw material powders by a combustion synthesis method, melting the combustion synthesized compound, and casting the melted compound into the desired shape by a lost wax method.

2. A method as in claim 1, wherein the ratio of Ni and Ti powders is adjusted in order to obtain a shape memory effect.

3. A method as in claim 1, wherein the ratio of Ni and Ti powders is adjusted in order to obtain a super-elasticity effect.

4. A method as in claim 1, further comprising applying a shape memory heat treatment to a product, which is formed by casting, in a free state.

5. A method as in claim 1, wherein the combustion synthesized compound is melted at about 1300° C.

* * * * *

UNITED STATES PATENT AND TRADEMARK OFFICE

CERTIFICATE OF CORRECTION

PATENT NO. : 7,112,302 B2
APPLICATION NO. : 10/849010
DATED : September 26, 2006
INVENTOR(S) : Yukiharu Yoshimi, Yasushi Okumura and Masataka Tokuda It is certified that error appears in the above-identified patent and that said Letters Patent is hereby corrected as shown below:

On the cover page, item (75) Inventors:

change: "Yoshiharu Yoshimi, Obu (JP); Yasushi Okumura, Nagoya (JP); Masataka Tokuda, Tsu (JP)"

to: -- Yukiharu Yoshimi, Obu (JP); Yasushi Okumura, Nagoya (JP); Masataka Tokuda, Tsu (JP)--

Signed and Sealed this

Ninth Day of January, 2007

JON W. DUDAS
*Director of the United States Patent and Trademark Office*